United States Patent [19]

Tanaka et al.

[11] 4,061,319

[45] Dec. 6, 1977

[54] MOBILE TRUCK FOR RELINING A CONVERTER

[75] Inventors: Sadaharu Tanaka; Sadayuki Saito; Sensaburo Hirano, all of Chiba, Japan

[73] Assignee: United States Steel Corporation, Pittsburgh, Pa.

[21] Appl. No.: 718,239

[22] Filed: Aug. 27, 1976

[30] Foreign Application Priority Data

Aug. 29, 1975 Japan ..... 50-118205[U]

[51] Int. Cl.[2] ..... C21C 5/44

[52] U.S. Cl. ..... 266/281

[58] Field of Search ..... 52/749; 182/128; 266/142, 158, 281, 287

[56] References Cited

U.S. PATENT DOCUMENTS

| | | | |
|---|---|---|---|
| 3,022,990 | 2/1962 | McFeaters et al. | 266/158 |
| 3,083,957 | 4/1963 | Langer et al. | 266/158 |
| 3,679,071 | 7/1972 | Smith | 52/749 |
| 3,866,382 | 2/1975 | Van Tassel | 266/287 X |

*Primary Examiner*—Gerald A. Dost

*Attorney, Agent, or Firm*—John F. Carney

[57] ABSTRACT

The rebricking of a converter lining is facilitated by a mobile truck arranged to carry a winch-operated platform to be lowered into the converter when the truck is disposed in overlying relation to the mouth thereof. The truck is moved along rails, at least part of which are rails that mount the movable lower portion of the converter hood.

1 Claim, 5 Drawing Figures

MOBILE TRUCK FOR RELINING A CONVERTER

BACKGROUND OF THE INVENTION

The present device relates to an on-furnace truck for brick lining in a converter such as a top blowing converter, a bottom blowing converter or the like. More particularly, the present device relates to a truck for brick lining, which is disposed on the top portion of a converter so that it can advance and retreat.

The conventional operation stand or a scaffold disposed on the mouth of a converter for brick lining in the converter is composed of plank frames of the collapsible type, and it must be assembled when the brick-lining operation is initiated and must be disassembled when the brick lining operation is completed. Accordingly, much time and labor are required for the brick lining operation. Further, the operation stand per se is incomplete. Moreover, a movable temporary beam is attached to the upper portion of the throat and charging of bricks is performed by moving up and down a transporting tool through this beam. Accordingly, this beam must also be attached and dismounted at every brick lining operation. The present device is to solve these problems involved in the conventional brick lining operation.

SUMMARY OF THE INVENTION

In accordance with the present invention there is provided in an organization for the pneumatic production of steel including a steelmaking converter having an upwardly opening mouth, a gas collection hood operatively disposed over the mouth of said converter, means for removing at least the lowermost portion of said hood from its operative position over the mouth of said converter including rails straddling the mouth of said converter in superposed relation thereto, the improvement comprising a mobile truck having wheels mounted on said rails, platform means carried by said truck, winch means mounted on said truck and operatively connecting said platform means for raising and lowering the same to and from the interior of said converter when said truck is disposed in overlying relation to the mouth thereof, and means for moving said truck into overlying relation to the mouth of said converter when said hood portion is removed therefrom.

It is accordingly a primary object of the present device to provide an economical on-furnace truck for brick lining in a converter, which can be attached to the converter very easily at a low cost by utilizing rails of a hood-moving truck disposed on the top of the converter so that it can advance and retreat and which can be used repeatedly for a long time for the brick lining operation in the converter.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
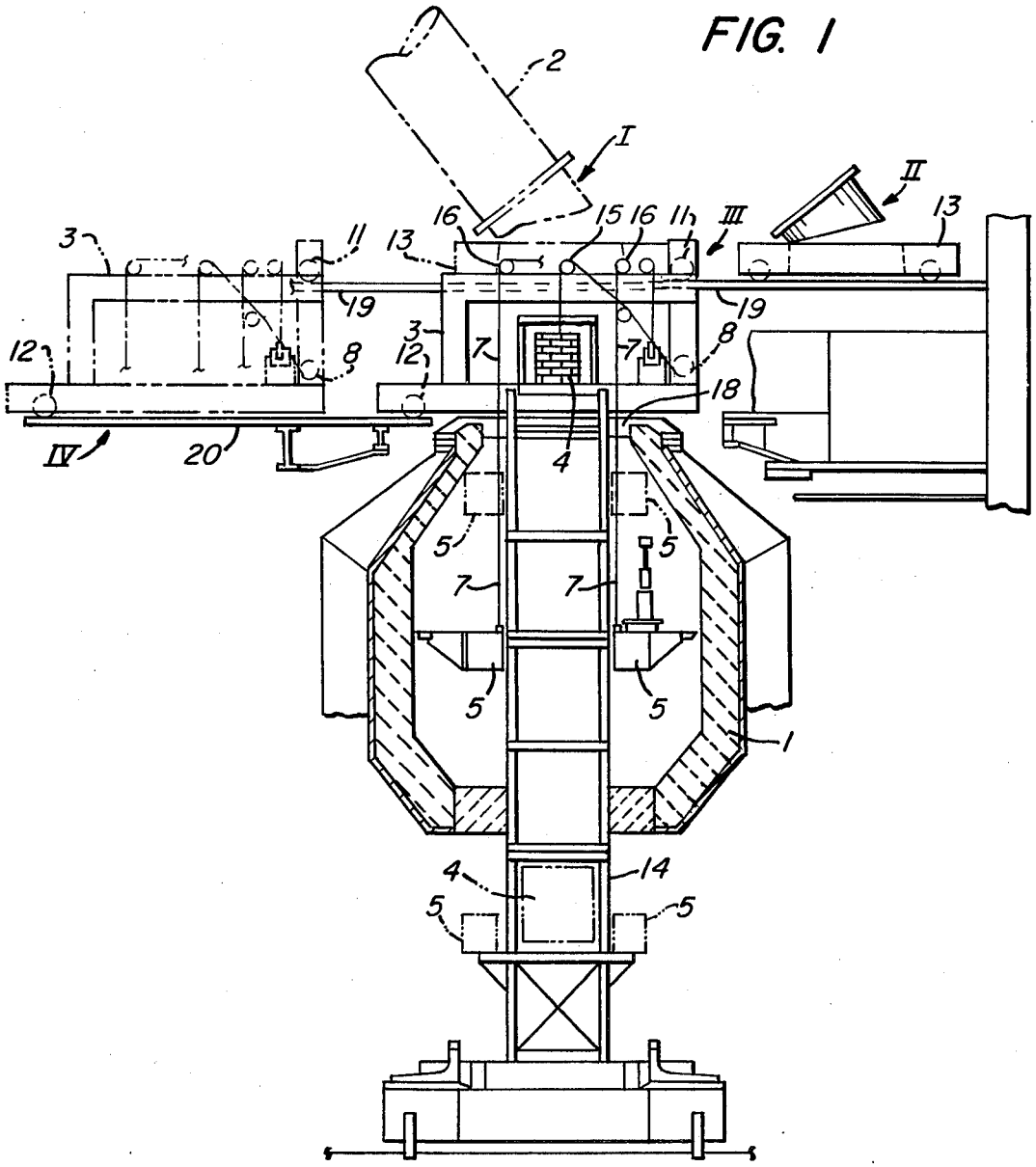
FIG. 1 is a sectional view showing a converter to which the apparatus of the present device is attached.

In accordance with the present device, there is provided an on-furnace truck comprising a rectangular truck 3 having front wheels 11 running on rails 19. The rails 19 also mount a truck 13 for carrying thereon a hood which is disposed on the top portion of the converter 1 so that it can advance and retreat. Rear wheels 12 run on other rails 20 laid horizontally on the level of the top end of the converter. An opening 17 is provided at the center of the truck 3, and a brick charging cage 4 can be lowered from the truck 3 into the interior of the converter through said opening 17 of the truck 3 and the mouth 18 of the converter when the truck 3 is positioned just above the converter. A stand 5 may be provided for the bricking operation, as well as driving winches 8 and 9 for moving up and down the cage 4 and operation stand 5.

Embodiments of the on-furnace truck for brick lining in a converter according to the present device will now be described in detail by reference to the accompanying drawings.

Figure 2:
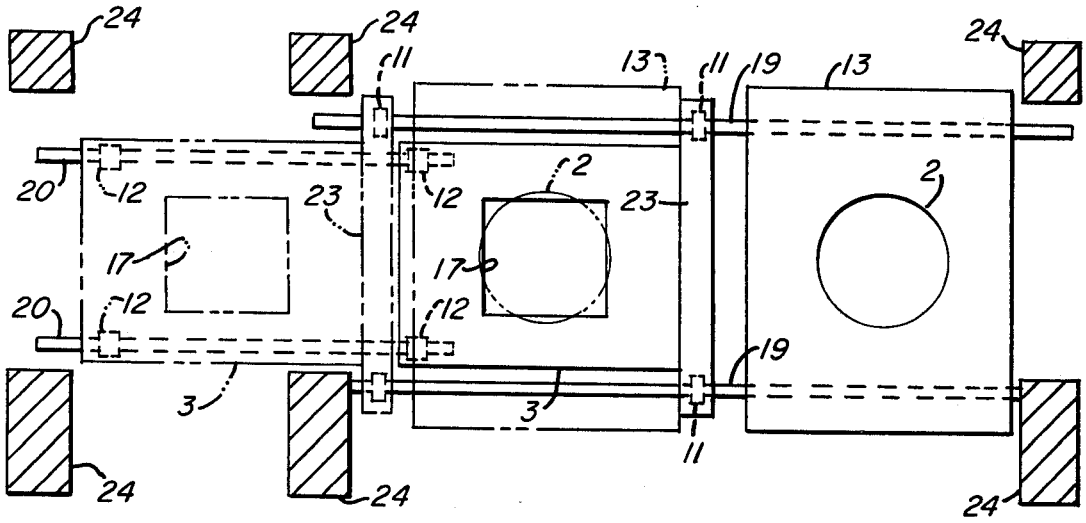
FIG. 2 is a plan view showing rails of the apparatus shown in FIG. 1.
Figure 5:
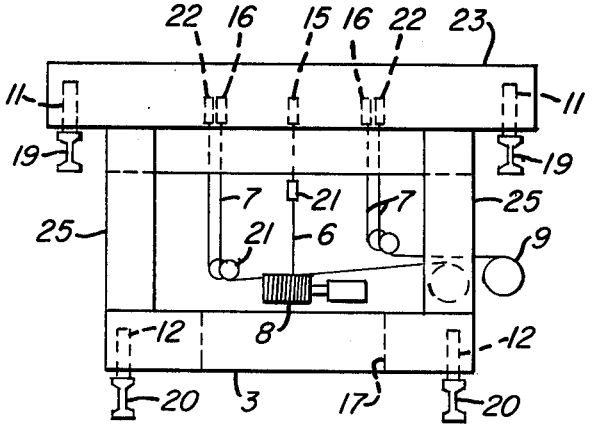
FIG. 5 is an end view showing the truck illustrated in FIG. 3.
Figure 4:
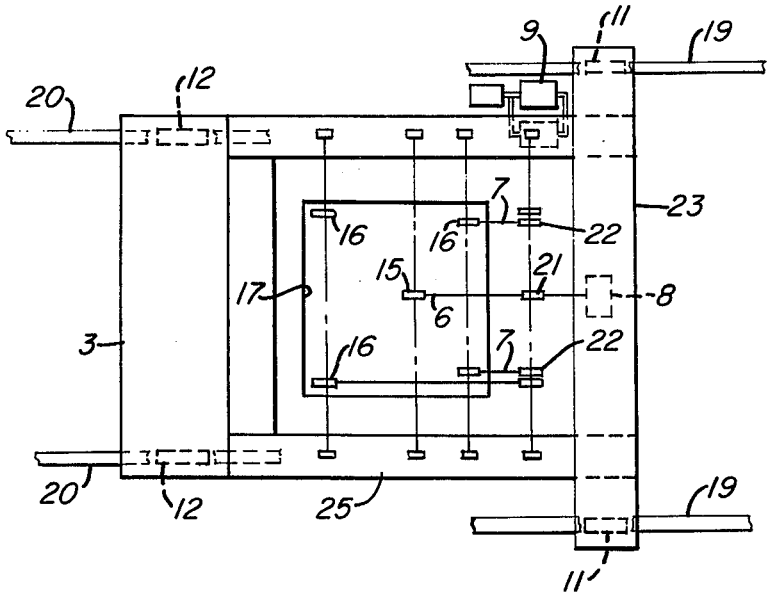
FIG. 4 is a plan view showing the truck illustrated in FIG. 3.
Figure 3:
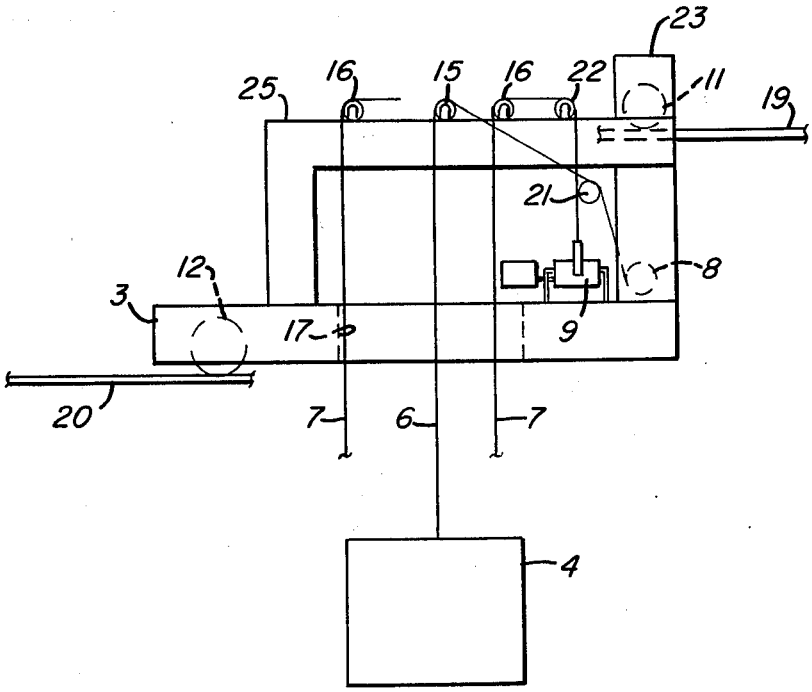
FIG. 3 is a side view showing a truck of the apparatus shown in FIG. 1.

Referring now to FIG. 1, a hood 2 is disposed on the top portion of a bottom blowing converter 1, and the hood 2 is carried on a truck 13 to make a reciprocative movement between an operation point I indicated by a dotted chain line and a repair point II indicated by a solid line. The truck 13 moves on and along rails 19 laid above a mouth 18. The apparatus of the present device is characterized in that another truck 3 is provided which utilizes the rails 19 of the hood carrying truck 13. The truck 3 has front wheels running on and along the rails 19 and rear wheels 12 running on other rails 20 laid on a floor at substantially the same level as that of the top end of the converter (see FIGS. 1 and 2). Since the rails 19 are laid at a position higher than the rails 20, the wheels 11 are attached to a bridge member 23. The truck 3 makes a reciprocative movement on the converter between an operation position III and a turnout position IV. The truck 3 has at the center thereof an opening 17 having a size substantially equal to the size of the mouth 18, and when the truck 3 is positioned just above the converter 1, the center of the opening 17 is in agreement with the center of the mouth 18 (see FIGS. 1 and 4). A brick charging cage 4 is hung from a sheave 15 attached to side members 25 that support the bridge member 23 of the truck 3 above the opening 17 by means of a wire 6, one end of which is attached to the cage 4. The other end of the wire 6 is wound on a cage wind-up winch 8 through another sheave 21 (see FIG. 3). Bricking operation stands 5 are attached to ends of two wires 7 hung from two sheaves 16 attached to the upper portion of the bridge member 25. The opposite ends of the wires 7 are wound through another sheave 22 on a wind-up winch 9 for moving up and down the bricking operation stands.

Reference number 14 in FIG. 1 denotes a guide tower mounted to form a passage of the cage 4, and it is constructed from below the converter utilizing the wind-up winch 9 and attached to the truck 3. Reference number 24 in FIG. 2 denotes a pillar of a working house, and rails 19 and 20 are laid in a gap between these pillars.

When the brick lining operation is performed, the truck 3 is set at the operation position III after the hood 2 has been shifted to the repair position II, and the guide tower 14 is constructed from below the converter by using the wind-up winches. The operation stands are then hung in the converter by the wind-up winches 9 and the cage 4 is hung in the converter by the wind-up winches 8 to charge bricks into the converter.

As will be apparant from the foregoing description, in the apparatus of the present device, since the rails 19 of the hood moving truck 13, which are layed in the top portion of the converter, are utilized, only by attaching rails 20 to a deck on the top level of the converter, i.e., a deck referred to as a third floor, it is possible to install the operation truck for brick lining very easily at a low cost. Since bricks are directly loaded on the brick charging cage 4 of the truck 3 disposed above the converter by a fork lift (not shown), no worker is required other than an operator of the fork lift. Further, the bricklining operation stand 5 is a completed platform, which is only lifted at the start of the operation. Accordingly, the time and labor heretofore required for construction of an operation scaffold can be saved according to the present device. Moreover, the apparatus of the present device can be promptly and assuredly set at a desired position with ease, and it can be dismantled with ease. If desired, it can be used repeatedly for a long time on one converter. Accordingly, it is apparent that the apparatus of the present invention is very advantageous over a brick lining scaffold heretofore used, which has to be manually hung in a furnace.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. In an organization for the pneumatic production of steel including a steelmaking converter having an upwardly opening mouth, a gas collecting hood over the mouth of said converter, means for removing at least the lowermost portion of said hood from its operative position over said converter mouth including a pair of rails straddling the converter mouth in superposed relation thereto, the improvement comprising:

a. a second pair of rails parallel to, but spaced below said mouth-straddling rails and extending to a position closely adjacent said converter;

b. a mobile truck including a frame of generally rectangular configuration;

c. said frame having wheels mounted thereon for engagement with both of said rail pairs;

d. platform means carried by said truck;

e. winch means mounted on said truck and operatively connecting said platform means for raising and lowering the same to and from the interior of said converter when said truck is disposed in overlying relation to the mouth thereof; and f. means for moving said truck into overlying relation to the mouth of said converter when said hood portion is removed therefrom.

* * * * *